US009537231B2

(12) United States Patent
Hall et al.

(10) Patent No.: US 9,537,231 B2
(45) Date of Patent: Jan. 3, 2017

(54) CONNECTOR ASSEMBLY

(71) Applicant: Tyco Electronics Corporation, Berwyn, PA (US)

(72) Inventors: John Wesley Hall, Harrisburg, PA (US); Scott Stephen Duesterhoeft, Milton (CA)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/539,713

(22) Filed: Nov. 12, 2014

(65) Prior Publication Data

US 2016/0134032 A1 May 12, 2016

(51) Int. Cl.

| | |
|---|---|
| ***H01R 9/05*** | (2006.01) |
| ***H01R 24/40*** | (2011.01) |
| ***H01R 13/434*** | (2006.01) |
| ***H01R 43/02*** | (2006.01) |
| ***H01R 103/00*** | (2006.01) |
| ***H01R 13/52*** | (2006.01) |

(52) U.S. Cl.

CPC ..... *H01R 9/0518* (2013.01); *H01R 13/434* (2013.01); *H01R 24/40* (2013.01); *H01R 43/0207* (2013.01); *H01R 13/521* (2013.01); *H01R 2103/00* (2013.01)

(58) Field of Classification Search

CPC .. H01R 2103/00; H01R 9/0518; H01R 13/506
USPC ..... 439/578, 585, 63, 937, 885, 590
See application file for complete search history.

(56) References Cited

U.S. PATENT DOCUMENTS

| | | | | |
|---|---|---|---|---|
| 5,037,328 A | | 8/1991 | Karlovich | |
| 5,123,864 A | * | 6/1992 | Karlovich | H01R 4/184 439/585 |
| 5,195,906 A | * | 3/1993 | Szegda | H01R 9/0521 439/255 |

(Continued)

FOREIGN PATENT DOCUMENTS

| | | |
|---|---|---|
| DE | 201 09 367 U1 | 10/2001 |
| JP | 2006 344490 A | 12/2006 |
| WO | 99/36999 A1 | 7/1999 |

OTHER PUBLICATIONS

D.J. Hardy, S. Duesterhoeft, J. W. Hall, Cavity Insert Subassembly, Male, 180 degree, FAKRA, Part No. 2203264, Sep. 21, 2012, 2 pages, TE Connectivity, US.

(Continued)

*Primary Examiner* — Amy Cohen Johnson
*Assistant Examiner* — Oscar C Jimenez

(57) ABSTRACT

A connector assembly includes a center contact configured to be terminated to a center conductor of a cable. A dielectric holds the center contact. An outer contact surrounds the dielectric and the center contact. The outer contact has a mating segment extending from a mating end, a terminating segment extending from a cable end, and a middle segment between the mating and terminating segments. The terminating segment is configured to be terminated to a braid of the cable. The middle segment has a diameter that is less than the respective diameters of the mating and terminating segments. A cavity insert surrounds the middle segment of the outer contact. The cavity insert includes a receiving shell and a closing shell that are joined together at an interface.

20 Claims, 8 Drawing Sheets

(56) References Cited

U.S. PATENT DOCUMENTS

| | | | | |
|---|---|---|---|---|
| 5,695,357 | A * | 12/1997 | Wright | H01R 4/50 29/877 |
| 5,704,809 | A | 1/1998 | Davis | |
| 5,730,622 | A * | 3/1998 | Olson | H01R 24/44 439/575 |
| 6,109,963 | A * | 8/2000 | Follingstad | H01R 9/0521 439/578 |
| 6,827,615 | B2 * | 12/2004 | Axelsson | H01R 43/055 439/885 |
| 8,366,483 | B2 * | 2/2013 | Hardy | H01R 9/0518 439/578 |
| 2005/0054237 | A1 * | 3/2005 | Gladd | H02G 15/085 439/578 |
| 2011/0139592 | A1 * | 6/2011 | Su | H01R 13/506 200/51.02 |
| 2012/0202372 | A1 | 8/2012 | Hardy et al. | |

OTHER PUBLICATIONS

International Search Report, International Application No. PCT/US2015/059128, International Filing Date, Nov. 5, 2015.

* cited by examiner

CONNECTOR ASSEMBLY

BACKGROUND OF THE INVENTION

The subject matter herein relates generally to connector assemblies.

Radio frequency (RF) connector assemblies have been used for numerous applications including military applications and automotive applications, such as global positioning systems (GPS), antennas, radios, mobile phones, multimedia devices, and the like. The connector assemblies are typically coaxial cable connectors that are provided at the end of coaxial cables.

In order to standardize various types of connector assemblies, particularly the interfaces for such connector assemblies, certain industry standards have been established. One of these standards is referred to as FAKRA, which is an abbreviation for the German term Fachnormenausschuss Kraftfahrzeugindustrie. FAKRA is the Automotive Standards Committee in the German Institute for Standardization, representing international standardization interests in the automotive field. The FAKRA standard provides a system, based on keying and color coding, for proper connector attachment. Specific jack keys can only be connected to like plug keyways in FAKRA connectors. Secure positioning and locking of connector housings is facilitated by way of a FAKRA defined catch on the housing of a jack or first assembly and a cooperating latch on the housing of a plug or second assembly.

The connector assemblies include a center contact and an outer contact that provides shielding for the center contact. The connector assemblies also include an outer housing that includes a mating interface for coupling to a mating connector to allow the center and outer contacts to electrically engage corresponding center and outer mating contacts of the mating connector. The outer contact, with the center contact therein, is received within a cavity of the outer housing. A cavity insert is typically used to retain the outer contact within the cavity of the outer housing. The cavity insert is an adapter that may allow the outer contact to be compatible with various different outer housings.

Typically, the cavity insert is loaded onto the outer contact by sliding the cavity insert over an end of the outer contact. Usually the cavity insert is loaded over a rear or cable end of the outer contact which has a smaller diameter than a front or mating end of the outer contact. The cable end of the outer contact is configured to be terminated to a cable. As the diameter of the cable that terminates to the outer contact increases, the diameter of the cable end of the outer contact must increase to receive the cable therein. However, it may not be feasible to increase the diameter of the cavity insert to allow the cavity insert to fit over the cable end and/or mating end due to space restrictions within the outer housings. A need remains for a connector assembly that can accommodate larger diameter cables and still allow a cable insert to be loaded over the outer contact for retaining the outer contact within an outer housing.

BRIEF DESCRIPTION OF THE INVENTION

In one embodiment, a connector assembly is provided having a center contact, a dielectric, an outer contact, and a cavity insert. The center contact is configured to be terminated to a center conductor of a cable. The dielectric holds the center contact. The outer contact surrounds the dielectric and the center contact. The outer contact has a mating segment extending from a mating end, a terminating segment extending from a cable end, and a middle segment between the mating and terminating segments. The terminating segment is configured to be terminated to a braid of the cable. The middle segment has a diameter that is less than the respective diameters of the mating and terminating segments. The cavity insert surrounds the middle segment of the outer contact. The cavity insert includes a receiving shell and a closing shell that are joined together at an interface.

In another embodiment, a connector assembly is provided having a center contact, a dielectric, an outer contact, and a cavity insert assembly. The center contact is configured to be terminated to a center conductor of a cable. The dielectric holds the center contact. The outer contact surrounds the dielectric and the center contact. The outer contact has a mating segment extending from a mating end, a terminating segment extending from a cable end, and a middle segment between the mating and terminating segments. The terminating segment is configured to be terminated to a braid of the cable. The middle segment has a diameter that is less than the respective diameters of the mating and terminating segments. The cavity insert assembly includes a receiving shell, a closing shell, and a bridge that connects the receiving shell to the closing shell. The receiving shell, closing shell, and the bridge are co-molded as part of a unitary cavity insert body. The receiving shell defines a channel that is configured to receive the middle segment of the outer contact therein.

DETAILED DESCRIPTION OF THE INVENTION

Figure 1:
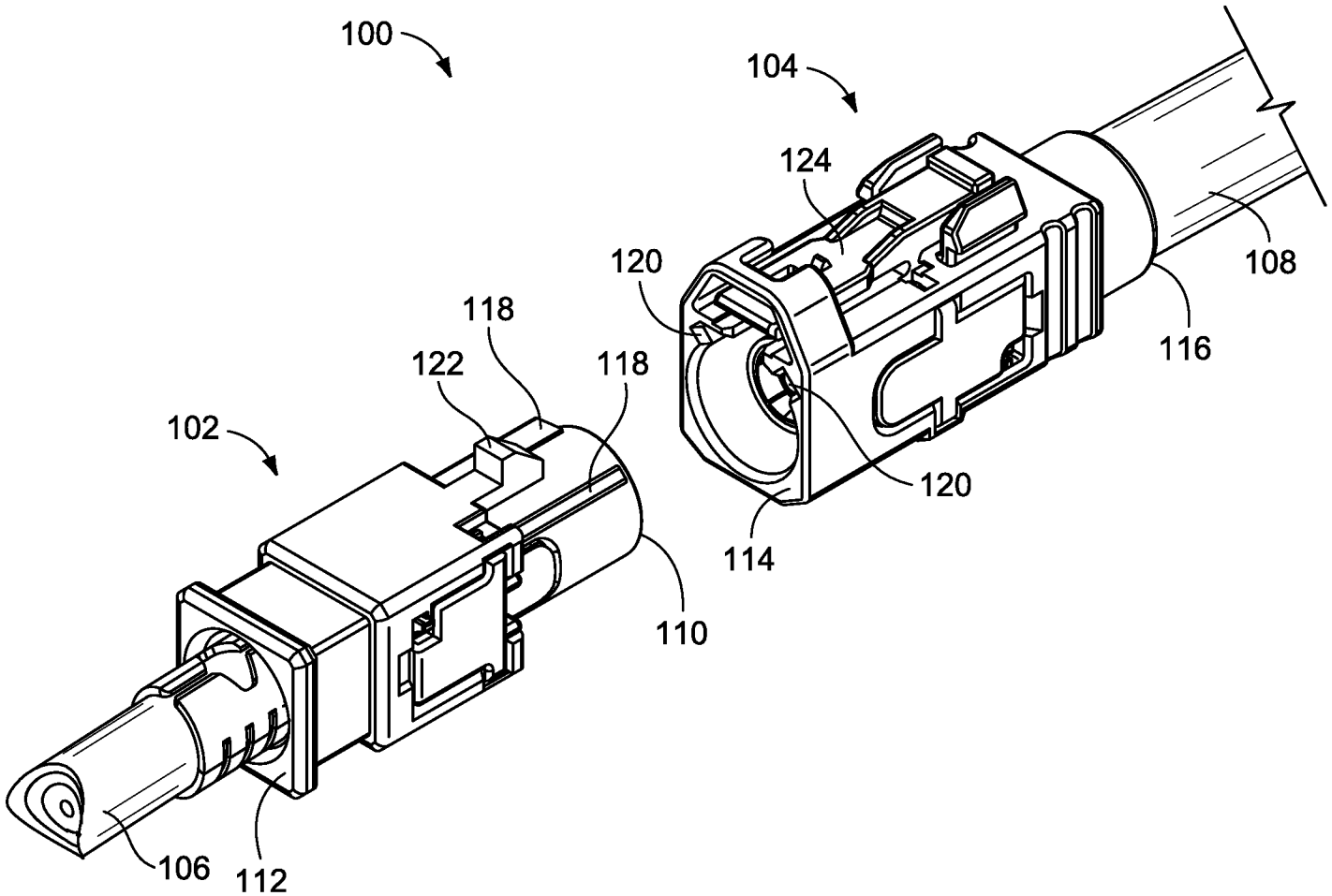
FIG. 1 illustrates a connector system formed in accordance with an exemplary embodiment including a first connector assembly and a second connector assembly.

FIG. 1 illustrates a connector system 100 formed in accordance with an exemplary embodiment. The connector system 100 includes a first connector assembly 102 and a second connector assembly 104. The first connector assembly 102 and the second connector assembly 104 are configured to be connected together to transmit electrical signals therebetween. For example, a center contact and an outer contact of the first connector assembly 102 may engage respective center and outer contacts of the second connector assembly 104 to provide a conductive signal path across the connector assemblies 102, 104. Optionally, the first connector assembly 102 may constitute a jack assembly, such that the center contact has a pin at a mating end that engages the center contact of the second connector assembly 104. Conversely, the second connector assembly 104 may be a plug assembly, such that the center contact forms a socket at a mating end that is configured to receive the pin of the first connector assembly 102 therein. Alternatively, the first connector assembly 102 may constitute a plug assembly, and the second connector assembly 104 may be a jack assembly.

The first connector assembly 102 is terminated to a cable 106. The second connector assembly 104 is terminated to a cable 108. In an exemplary embodiment, the cables 106, 108 are coaxial cables. For example, the cables 106, 108 may be coaxial cables of type RG-59, RG-62, RG-71, and the like. Signals transmitted along the cables 106, 108 are transferred through the first connector assembly 102 and second connector assembly 104 when connected.

The first connector assembly 102 has a mating end 110 and a cable end 112. The first connector assembly 102 is terminated to the cable 106 at the cable end 112. The second connector assembly 104 has a mating end 114 and a cable end 116. The second connector assembly 104 is terminated to the cable 108 at the cable end 116. During mating, the mating end 110 of the first connector assembly 102 is plugged into the mating end 114 of the second connector assembly 104.

In the illustrated embodiment, the first connector assembly 102 and the second connector assembly 104 constitute FAKRA connectors which are RF connectors that have an interface that complies with the standard for a uniform connector system established by the FAKRA automobile expert group. The FAKRA connectors have a standardized keying system and locking system that fulfill the high functional and safety requirements of automotive applications. The FAKRA connectors are based on a subminiature version B connector (SMB connector) that feature snap-on coupling and are designed to operate at specific impedances, such as 50, 75, 93, and/or 125 Ohms. The connector system 100 may utilize other types of connectors other than the FAKRA connectors described herein.

The first connector assembly 102 has one or more keying features 118 and the second connector assembly 104 has one or more keying features 120 that correspond with the keying features 118 of the first connector assembly 102. In the illustrated embodiment, the keying features 118 are ribs and the keying features 120 are channels that receive the ribs. Any number of keying features may be provided, and the keying features may be part of the standardized design of the FAKRA connector.

The first connector assembly 102 has a latching feature 122 and the second connector assembly 104 has a latching feature 124. The latching feature 122 is defined by a catch and the latching feature 124 is defined by a latch that engages the catch to hold the first connector assembly 102 and the second connector assembly 104 mated together.

Figure 2:
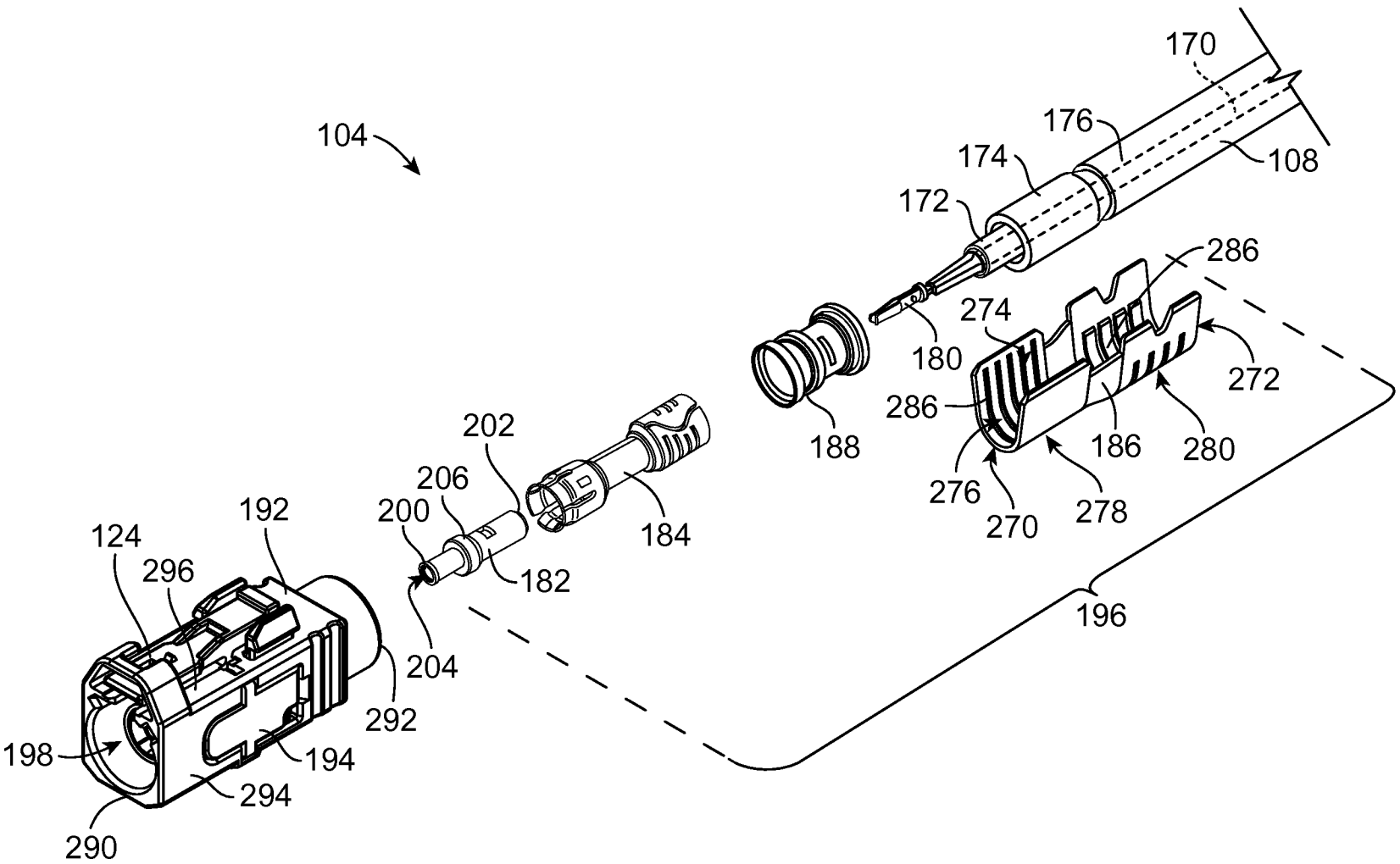
FIG. 2 is an exploded view of the second connector assembly shown in FIG. 1.
Figure 3:
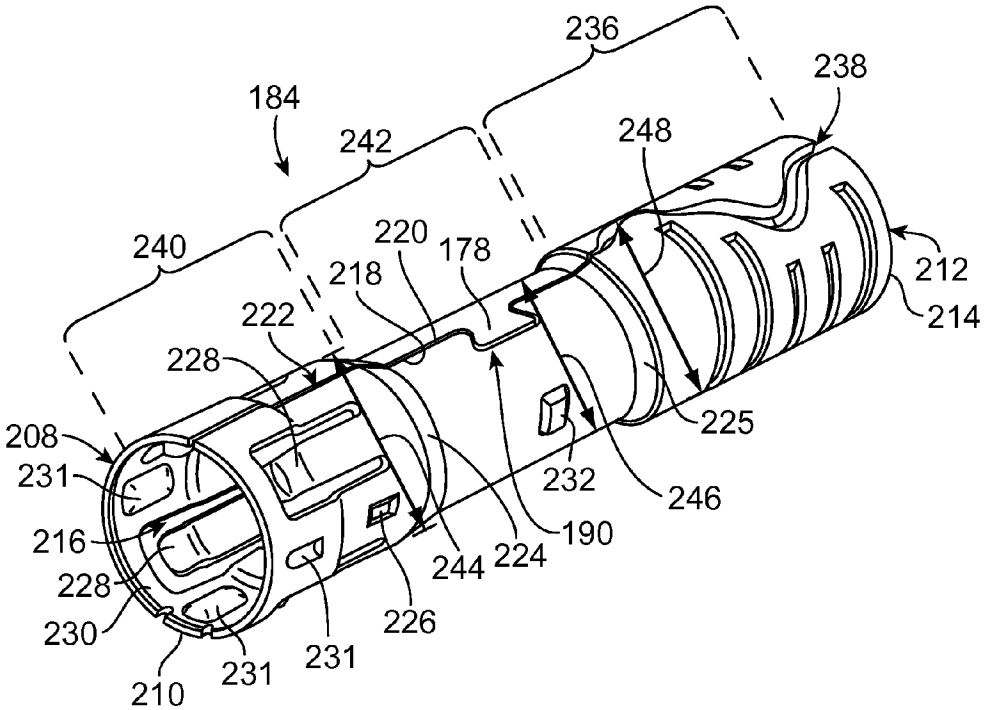
FIG. 3 is a perspective view of an outer contact of the second connector assembly according to an exemplary embodiment.
Figure 4:
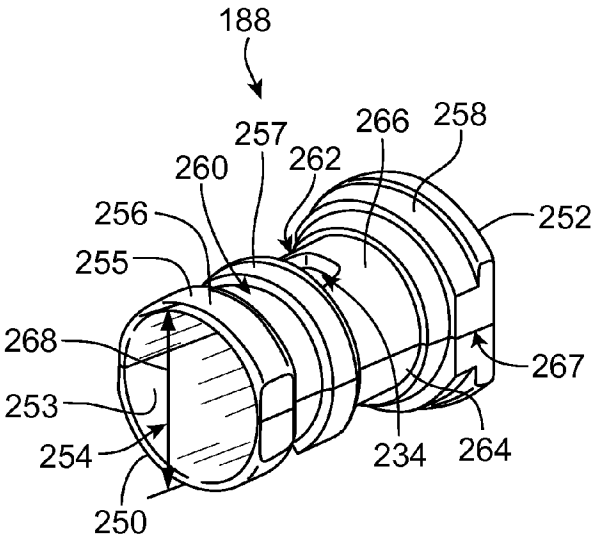
FIG. 4 is a perspective view of a cavity insert of the second connector assembly according to an exemplary embodiment.

FIG. 2 is an exploded view of the second connector assembly 104 and the cable 108. FIG. 3 is a perspective view of an outer contact 184 of the second connector assembly 104 according to an exemplary embodiment. FIG. 4 is a perspective view of a cavity insert 188 of the second connector assembly 104 according to an exemplary embodiment.

With reference to FIG. 2, the second connector assembly 104 includes a center contact 180, a dielectric 182, the outer contact 184, an outer ferrule 186, the cavity insert 188, and an outer housing 192. In other embodiments, the second connector assembly 104 may include one or more additional components and/or may not include all of the listed components.

The cable 108 may be a coaxial cable having a center conductor 170 surrounded by a dielectric 172. A cable braid 174 surrounds the dielectric 172. The cable braid 174 provides shielding for the center conductor 170 along the length of the cable 108. A cable jacket 176 surrounds the cable braid 174 and provides protection for the cable braid 174, dielectric 172, and center conductor 170 from external forces and contaminants.

In the illustrated embodiment, the center contact 180 constitutes a socket contact that is configured to receive and electrically engage a pin contact of the first connector assembly 102 (shown in FIG. 1). However, other types of contacts are possible in alternative embodiments. The center contact 180 is terminated to the center conductor 170 of the cable 108. For example, the center contact 180 may be crimped to the center conductor 170.

The dielectric 182 receives and holds the center contact 180 and possibly a portion of the center conductor 170 of the cable 108. The outer contact 184 receives the dielectric 182 therein. The dielectric 182 electrically isolates the center contact 180 from the outer contact 184. The outer contact 184 surrounds the dielectric 182 and the center contact 180. The outer contact 184 provides shielding for the center contact 180, such as from electromagnetic or radio frequency interference. In an exemplary embodiment, the outer contact 184 is stamped and formed. The outer contact 184 is configured to be electrically connected to the cable braid 174.

The outer ferrule 186 is configured to be crimped to the cable 108 and the outer contact 184. The outer ferrule 186 provides electrical termination of the braid to the outer contact and strain relief for the cable 108. In an exemplary embodiment, the outer ferrule 186 is configured to be crimped to both the cable braid 174 and the cable jacket 176 of the cable 108. For example, the outer ferrule 186 may be crimped to the cable braid 174 and the cable jacket 176 using a bypass crimp or another type of crimp.

The cavity insert 188 surrounds at least a portion of the outer contact 184 and is axially secured with respect to the outer contact 184 to hold the outer contact 184 therein. The cavity insert 188 is received within the outer housing 192 and is held therein by a retainer 194. The cavity insert 188 is used to hold the true position of the outer contact 184 within the outer housing 192. The cavity insert 188 has a predetermined outer perimeter that corresponds with the outer housing 192 such that the cavity insert 188 is configured to be secured within the outer housing 192.

The center contact 180, dielectric 182, outer contact 184, outer ferrule 186, and cavity insert 188 define a second connector subassembly 196 that is configured to be loaded into the outer housing 192 as a unit. Other components may also be part of the second connector subassembly 196. The outer housing 192 includes a cavity 198 that receives the second connector subassembly 196 therein. The retainer 194 holds the second connector subassembly 196 in the cavity 198.

The outer housing 192 extends between a front 290 and a rear 292. The retainer 194 is loaded through a side 294 of the outer housing 192. The latching feature 124 is provided along a top 296 of the outer housing 192. As used herein, relative or spatial terms such as "front," "rear," "top," or "bottom" are only used to distinguish the referenced elements and do not necessarily require particular positions or orientations in the connector system 100 or in the surrounding environment of the connector system 100. The outer housing 192 has a generally boxed shape outer profile. The cavity 198 of the outer housing 192 is generally a cylindrical bore extending through the outer housing 192. The cavity 198 may have steps, shoulders and/or channels formed therein for receiving and holding the cavity insert 188.

The dielectric 182 extends between a front 200 and a rear 202. The dielectric 182 has a cavity 204 that receives the center contact 180 therein. The dielectric 182 includes a flange 206 that extends radially outward therefrom. Optionally, the flange 206 may be approximately centrally located between the front 200 and the rear 202. The flange 206 is used to position the dielectric 182 within the outer contact 184.

With additional reference to FIG. 3, the outer contact 184 has a mating end 208 at a front 210 thereof and a cable end 212 at a rear 214 thereof. The outer contact 184 has a cavity 216 extending between the front 210 and the rear 214. In an exemplary embodiment, the outer contact 184 may have a barrel shape that is stepped. The barrel shape may be generally cylindrical or cylindrical along different segments or portions. In an exemplary embodiment, the outer contact 184 includes a mating segment 240, a terminating segment 236, and a middle segment 242 between the mating and terminating segments 240, 236. The mating segment 240 extends rearward from the mating end 208. The terminating segment 236 extends frontward from the cable end 212.

The mating segment 240 is configured to engage an outer mating contact (not shown) of the first connector assembly 102 (shown in FIG. 1) or another mating connector assembly. The mating segment 240 includes a plurality of contact beams 228. The contact beams 228 are deflectable and are configured to be spring loaded against an outer mating contact of the first connector assembly 102. For example, the outer mating contact may be received within the cavity 216 along the mating segment 240 such that the mating segment surrounds at least part of the outer mating contact. The mating segment 240 may has a diameter 244 that is large enough to accommodate a distal end of the outer mating contact within the cavity 216. The contact beams 228 may be profiled to have an area of reduced diameter at the mating end 208 to ensure that the contact beams 228 engage the outer mating contact. Each of the individual contact beams 228 are separately deflectable and exert a normal force on the outer mating contact to ensure engagement of the outer contact 184 with the outer mating contact.

The mating end 208 may include a ring 230 at the front 210. The contact beams 228 extend rearward of the ring 230 and are disposed between the ring 230 and the middle segment 242 of the outer contact 184. The ring 230 is positioned forward of the contact beams 228 to protect the contact beams 228 from damage during loading of the outer contacts 228 into the outer housing 192 and/or during mating with the first connector assembly 102. In an alternative embodiment, the mating end 208 does not include the ring 230 and the contact beams 228 define at least part of the mating end 208. The mating end 208 may also include a plurality of protrusions 231 that extend radially inward from the mating segment 240 into the cavity 216. The protrusions 231 may be positioned between the contact beams 228 and, like the contact beams 228, may be configured to engage the outer mating contact of the mating connector assembly, such as the first connector assembly 102. In the illustrated embodiment, four contact beams 228 and four protrusions 231 are provided, defining eight points of contact with the outer mating contact.

The middle segment 242 is rearward of the mating segment 240. The middle segment 242 is configured to be peripherally surrounded by the cavity insert 188. The middle segment 242 may include a securing feature 232 that engages a complementary securing feature 234 (shown in FIG. 4) on the cavity insert 188 to hold the axial position of the outer contact 184 with respect to the cavity insert 188. For example, the securing feature 232 may be a positioning tab that extends radially outward from the middle segment 242. The positioning tab may be received in an aperture defined along an interior surface of the cavity insert 188 that forms the securing feature 234. In an exemplary embodiment, the middle segment 242 has a diameter 246 that is less than the diameter 244 of the mating segment 240. The reduced diameter 246 allows the middle segment 242 of the outer contact 184 to be surrounded by the cavity insert 188, while allowing the entire second connector subassembly 196 to fit within the cavity 198 of the outer housing 192. For example, if the diameter of the middle segment 242 is not reduced compared to the mating segment 240, the cavity insert 188 would need to be formed with a larger diameter to fit over and surround the outer contact 184. As a result, the larger cavity insert 188 would not fit properly within the cavity 198 of the outer housing 192. Typically the size of the cavity 198 and the outer housing 192 are fixed or pre-defined based on industry standards and specifications, so it may not be feasible to increase the size of the cavity 198 to accommodate a larger cavity insert 188. As such, the diameter 246 of the middle segment 242 may be constrained to a narrow range of sizes in order to allow the second connector subassembly 196 to be held within one or more outer housings 192 with pre-defined cavity 198 sizes.

The terminating segment 236 is configured to be terminated to the cable braid 174 of the cable 108. For example, the center contact 180 and the dielectric 172 may be received within the cavity 216 through the cable end 212, and the cable braid 174 may be received over the terminating segment 236, such that the terminating segment 236 is sandwiched between the dielectric 172 and the cable braid 174. In an exemplary embodiment, the terminating segment 236 has a diameter 248 that is greater than the diameter 246 of the middle segment 242. The diameter 248 of the terminating segment 236 may be based on the size or gauge of the cable 108 that is terminated to the terminating segment 236. The terminating segment 236 may be configured to terminate to cables that would not fit within the terminating segment 236 if the diameter was equal to or less than the diameter 246 of the middle segment 242, for example. The difference between the larger diameter 248 of the terminating segment 236 and the smaller diameter 246 of the middle segment 242 allows the outer contact 184 to accommodate larger cables while still allowing the second connector subassembly 196 to fit within a fixed cavity 198 of the outer housing 192.

As shown in FIG. 3, the diameter 246 of the middle segment 242 is less than the respective diameters 244, 248 of the mating and terminating segments 240, 236. The outer contact 184 is stepped along the length to define at least a first shoulder 224 and a second shoulder 225. The first shoulder 224 separates the mating segment 240 from the middle segment 242. The second shoulder 225 separates the middle segment 242 from the terminating segment 236. Moving rearward along the length of the outer contact 184, the first shoulder 224 steps down from the mating segment 240 to the middle segment 242. The second shoulder 225 steps up from the middle segment 242 to the terminating segment 236.

When the dielectric 182 is loaded into the cavity 216, the flange 206 may engage the first shoulder 224 to axially position the dielectric 182 with respect to the outer contact 184. The outer contact 184 may include one or more retention tabs 226 that extend into the cavity 216 to engage the dielectric 182 to hold the dielectric 182 in the outer contact 184. For example, the rear facing surface of the flange 206 may engage the first shoulder 224, prohibiting further movement of the dielectric 182 towards the rear 214 of the outer contact 184. The retention tab 226 may engage the front facing surface of the flange 206, prohibiting frontward movement of the dielectric 182 relative to the outer contact 184. The flange 206 is thus captured between the shoulder 224 and the retention tab 226 to hold the axial position of the dielectric 182 within the outer contact 184. Other types of securing or positioning elements may be used in alternative embodiments for positioning or securing the dielectric 182 in the outer contact 184.

The outer contact 184 may be stamped and formed from a flat workpiece that is rolled into the barrel shape. The flat workpiece has a first end 218 and a second end 220 that are rolled toward one another into the barrel shape until the first and second ends 218, 220 oppose one another. A seam 222 is created at the interface between the first and second ends 218, 220. The first and second ends 218, 220 may touch one another at the interface of the seam 222. The first and second ends 218, 220 may be secured together at the seam 222 to hold the barrel shape. For example, the second end 220 may have a tab 178 that is received and retained within a complementary pocket 190 defined in the first end 218, or vice-versa. Optionally, the tab 178 and pocket 190 may be axially located along the middle segment 242. In an alternative embodiment, rather than being stamped and formed, the outer contact 184 may be made by another manufacturing method, such as die-casting, extrusion, screw machining, or the like.

In an exemplary embodiment, a gap 238 is defined along the seam 222 between the first and second ends 218, 220 of the terminating segment 236. The gap 238 optionally may extend along a tortuous path, as shown in FIG. 3. The size of the gap 238 is variable to change a diameter of the terminating segment 236. Changing the size of the gap 238 changes the radius of the outer contact 184 surrounding the center conductor 170 and/or the center contact 180, thereby affecting the capacitance between inner and outer conductors, and controlling the impedance. The size of the gap 238 may be controlled by the outer ferrule 186. For example, by crimping the outer ferrule 186 around the terminating segment 236, the terminating segment 236 may be squeezed to close the gap 238, which affects the impedance.

Referring now to FIG. 4 with continued reference to FIGS. 2 and 3, the cavity insert 188 includes a front end 250 and a rear end 252. The cavity insert 188 may be barrel-shaped with one or more cylindrical regions. The cavity insert 188 has an inner surface 253 that defines a channel 254 through the cavity insert 188 between the front and rear ends 250, 252. The channel 254 is configured to receive the outer contact 184 therein. For example, the channel 254 may receive the middle segment 242 of the outer contact 184 such that the cavity insert 188 surrounds the middle segment 242. Optionally, the cavity insert 188 may surround at least part of the mating segment 240 and/or the terminating segment 236 of the outer contact 184 in addition to the middle segment 242.

In an exemplary embodiment, the inner surface 253 that defines the channel 254 has a diameter 268 that may be at least slightly larger than the diameter 246 of the middle segment 242 to allow the cavity insert 188 to fully surround the perimeter of the middle segment 242. The diameter 268, however, may be at least slightly smaller than the diameters 244, 248 of the mating and terminating segments 240, 236, respectively, to allow the cavity insert 188 to fit within the cavity 198 of the outer housing 192. For example, if the cavity insert 188 has a diameter 268 that is larger than one or both of the diameters 244, 248, an outer surface 255 of the cavity insert 188 may not fit properly within the cavity 198 of the outer housing 192. Since the diameter 268 may be smaller than both the diameters 244, 248 of the mating and terminating segments 240, 236, which bookend the middle segment 242, the cavity insert 188 may not be loaded onto the outer contact 184 by sliding the cavity insert 188 over either the front 210 or the rear 214.

In an exemplary embodiment, the cavity insert 188 is formed of a two-piece construction, which includes a first shell 264 and a second shell 266. The first shell 264 forms a portion of the perimeter of the cavity insert 188, and the second shell 266 forms the remaining portion of the perimeter. The first and second shells 264, 266 may be separate pieces that are joined together at an interface 267 to form the assembled cavity insert 188 shown in FIG. 4. The outer contact 184 may be received first in one of the first and second shells 264, 266, and the other of the first and second shells 264, 266 may then be closed around the remainder of the perimeter of the outer contact 184. As used herein, the first shell 264 is referred to as the receiving shell 264 which receives the outer contact 184 first, and the second shell 266 is referred to as the closing shell 266, which subsequently is joined to the receiving shell 264 to enclose the perimeter of the outer contact 184. However, in an alternative embodiment, the second shell 266 may be the receiving shell and the first shell 264 may be the closing shell. In another alternative embodiment, the first and second shells 264, 266 may be moved towards the outer contact 184 at the same time such that both shells 264, 266 receive the outer contact 184 and close around the outer contact 184 at the same time.

During assembly of the second connector subassembly 196, the cavity insert 188 may initially be disassembled. The middle segment 242 of the outer contact 184 may be received in the receiving shell 264, and the closing shell 266 may be subsequently joined to the receiving shell 264. Thus, by using a two-piece construction, the cavity insert 188 need not be loaded over either of the mating segment 240 or the terminating segment 236 in order to reach the middle segment 242, and the cavity insert 188 may be sized based on the smaller diameter 246 of the middle segment 242.

The cavity insert 188 includes multiple flanges that extend circumferentially around the cavity insert 188. The flanges are configured to be received within the outer housing 192 to engage surfaces in the outer housing 192 to hold the axial position of the cavity insert 188 with respect to the outer housing 192. For example, in the illustrated embodiment, the cavity insert 188 includes at least a front flange 256, a middle flange 257, and a rear flange 258. The flanges 256-258 extend radially outward from the cavity insert 188. It is recognized that the flanges 256-258 need not be disposed at the front end 250, axial midpoint, and rear end 252 of the cavity insert 188, respectively. For example, the middle flange 257 may be located more proximal to the front end 250 than the rear end 252. The flanges 256-258 define grooves that are formed therebetween. For example, a first groove 260 may be formed between the front and middle flanges 256, 257, and a second groove 262 may be formed between the middle and the rear flanges 257, 258. In an embodiment, when the second connector subassembly 196 is inserted into the outer housing 192, an arm 374 (shown in FIG. 10) of the retainer 194 is received within the first groove 260. A rear surface of the arm 374 may contact the middle flange 257 and a front surface of the arm 374 may contact the front flange 256 to hold the cavity insert 188 in the cavity 198 of the outer housing 192.

Optionally, the cavity insert 188 may retain the axial position of the outer contact 184 by the securing feature 234 which engages the securing feature 232 of the outer contact 184. As described above, the securing feature 234 may be an aperture that is configured to receive a positioning tab of the outer contact 184 therein. Optionally, the aperture 234 may be elongated such that the outer contact 184 may be at least partially rotatable within the cavity insert 188. In another embodiment, the cavity insert 188 retains the axial position of the outer contact 184 by engaging the shoulders 224, 225 of the outer contact 184. For example, the first shoulder 224 may engage the front end 250 of the cavity insert 188 to prohibit rearward movement of the outer contact 184 relative to the cavity insert 188, and the second shoulder 225 may engage the rear end 252 to prohibit frontward movement of the outer contact 184 relative to the cavity insert 188. Other types of securing or positioning elements may be used in alternative embodiments for positioning or securing the outer contact 184 in the cavity insert 188.

Referring back to FIG. 2, the outer ferrule 186 may be stamped and formed from a flat work piece having a front 270 and a rear 272. The outer ferrule 186 may be formed into an open barrel shape, such as a U-shape that has an open top 274. The outer ferrule 186 defines a channel 276 that is configured to receive the cable 108 and the terminating segment 236 (shown in FIG. 3) of the outer contact 184. The outer ferrule 186 includes a braid segment 278 and a jacket segment 280. The braid segment 278 is provided at the front 270 of the outer ferrule 186 and the jacket segment 280 is provided at the rear 272 of the outer ferrule 186. The outer contact 184 is terminated to the cable 108 using the outer ferrule 186. For example, once the center contact 180 and dielectric 172 of the cable 108 are received within the terminating segment 236 of the outer contact 184 and the cable braid 174 is loaded around the terminating segment 236, the braid segment 278 may be loaded onto the cable braid 174 such that the cable braid 174 is sandwiched between the outer ferrule 186 and the terminating segment 236. The braid segment 278 may then be crimped to terminate the braid 174 of the cable 108 to the terminating segment 236 of the outer contact 184. The jacket segment 280 may be crimped around the cable jacket 176. Crimping both the braid segment 278 and the jacket segment 280 to the cable 108 provides strain relief for the cable 108. The outer ferrule 186 may include notches or serrations 286 that define surfaces that engage the cable braid 174 and/or cable jacket 176 to help hold the axial position of the outer ferrule 186 with respect to the cable 108.

Figure 5:
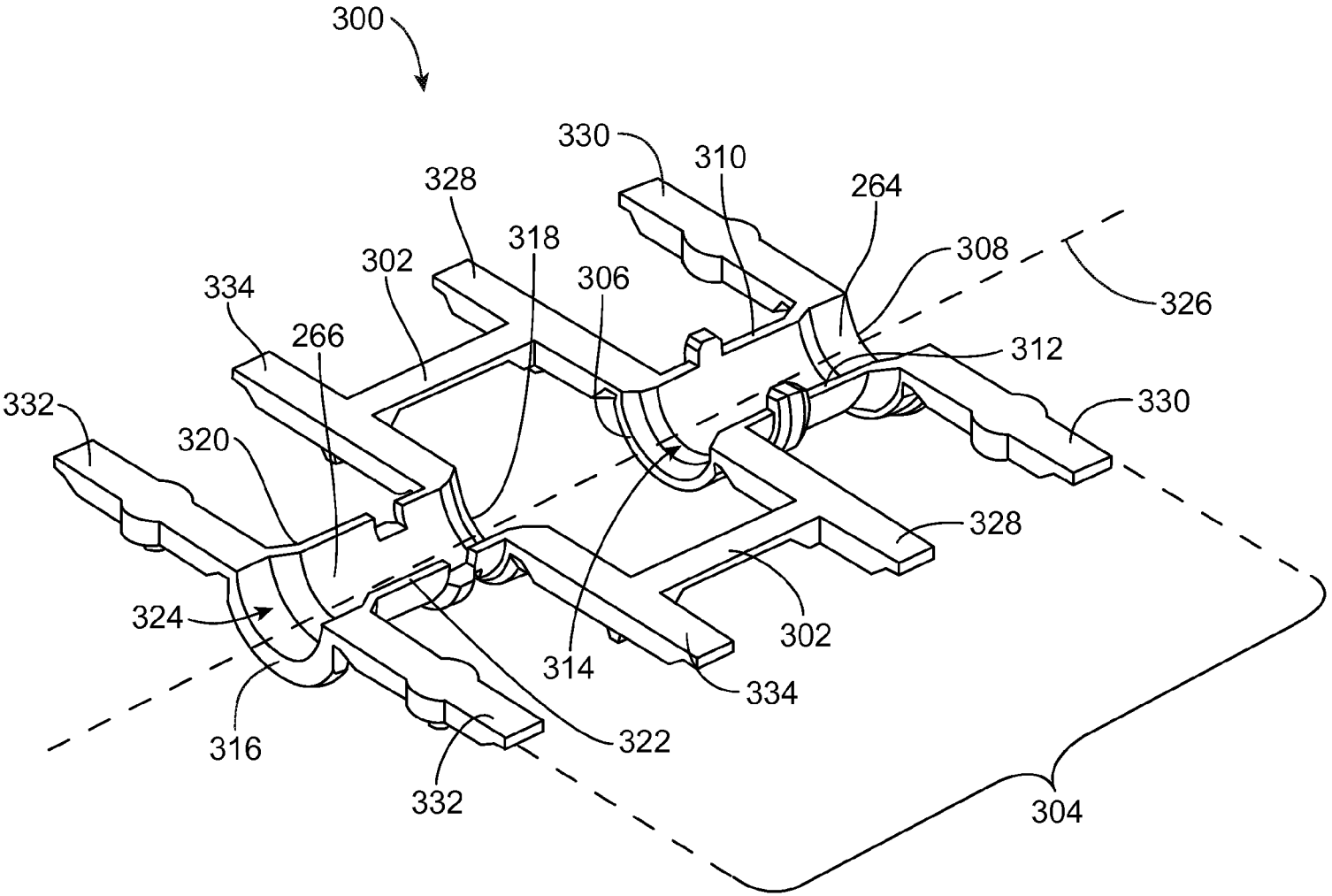
FIG. 5 is a perspective view of a cavity insert assembly according to an exemplary embodiment.

FIG. 5 is a perspective view of a cavity insert assembly 300 according to an exemplary embodiment. The cavity insert assembly 300 may be assembled to form the cavity insert 188 shown in FIG. 4. For example, the cavity insert assembly 300 includes the receiving shell 264 and the closing shell 266. The cavity insert assembly 300 further includes at least one bridge 302 that connects the receiving shell 264 to the closing shell 266. The illustrated embodiment shown in FIG. 5 includes two bridges 302. The bridges 302 may couple the receiving shell 264 directly to the closing shell 266 or indirectly via one or more rails that extend from one or both of the shells 264, 266, as described below. In an exemplary embodiment, the receiving shell 264, closing shell 266, at least one bridge 302, and any rails are co-molded as part of a unitary cavity insert body 304. For example, the cavity insert assembly 300 may be composed of a dielectric material, such as plastic, and may be commonly formed during a molding process.

The receiving shell 264 includes a front 306 and a rear 308. The receiving shell 264 also includes a first end 310 and an opposite second end 312. The receiving shell 264 may be curved such that the first and second ends 310, 312 curve toward each other and define a channel 314 therebetween. The channel 314 extends from the front 306 to the rear 308, and is configured to receive the middle segment 242 (shown in FIG. 3) of the outer contact 184 (FIG. 3) therein. Similarly, the closing shell 266 may include a front 316 and a rear 318. The closing shell 266 also includes a first end 320 and an opposite second end 322. The first and second ends 320, 322 may curve towards each other, defining a channel 324 therebetween. The channel 324 extends from the front 316 to the rear 318. The channel 324 may be configured to receive the middle segment 242 therein. In the illustrated embodiment, the receiving shell 264 and the closing shell 266 are both oriented along a cavity insert axis.

The cavity insert assembly 300 may further include at least one rail that extends from the receiving shell 264 and at least one rail that extends from the closing shell 266. For example, in the illustrated embodiment, four rails extend from the receiving shell 264, including two front rails 328 and two rear rails 330. The front rails 328 extend from the receiving shell 264 generally proximate to the front 306 of the receiving shell 264, and the rear rails 330 extend from the receiving shell 264 generally proximate to the rear 308. The rails 328, 330 extend from the receiving shell 264 at angles that are transverse to the cavity insert axis 326. For example, the rails 328, 330 may extend laterally from the receiving shell 264 at angles that are orthogonal to the cavity insert axis 326. Similarly, in the illustrated embodiment, two front rails 332 and two rear rails 334 extend from the closing shell 266. The front rails 332 are disposed proximate to the front 316, and the rear rails 334 are disposed proximate to the rear 318. The rails 332, 334 extend from the closing shell 266 at angles transverse to the cavity insert axis 326. Optionally, the rails 332, 334 may extend parallel to the rails 328, 330 that extend from the receiving shell 264. The bridges 302 connect the front rails 328 extending from the receiving shell 264 to the rear rails 334 extending from the closing shell 266. In other embodiments, the relative positions of the receiving and closing shells 264, 266 may be switched and the bridges 302 may connect the rear rails 330 extending from the receiving shell 264 to the front rails 332 extending from the closing shell 266. In an alternative embodiment, the bridges 302 extend directly from the receiving and closing shells 264, 266 to connect the receiving shell 264 to the closing shell 266.

Figure 6:
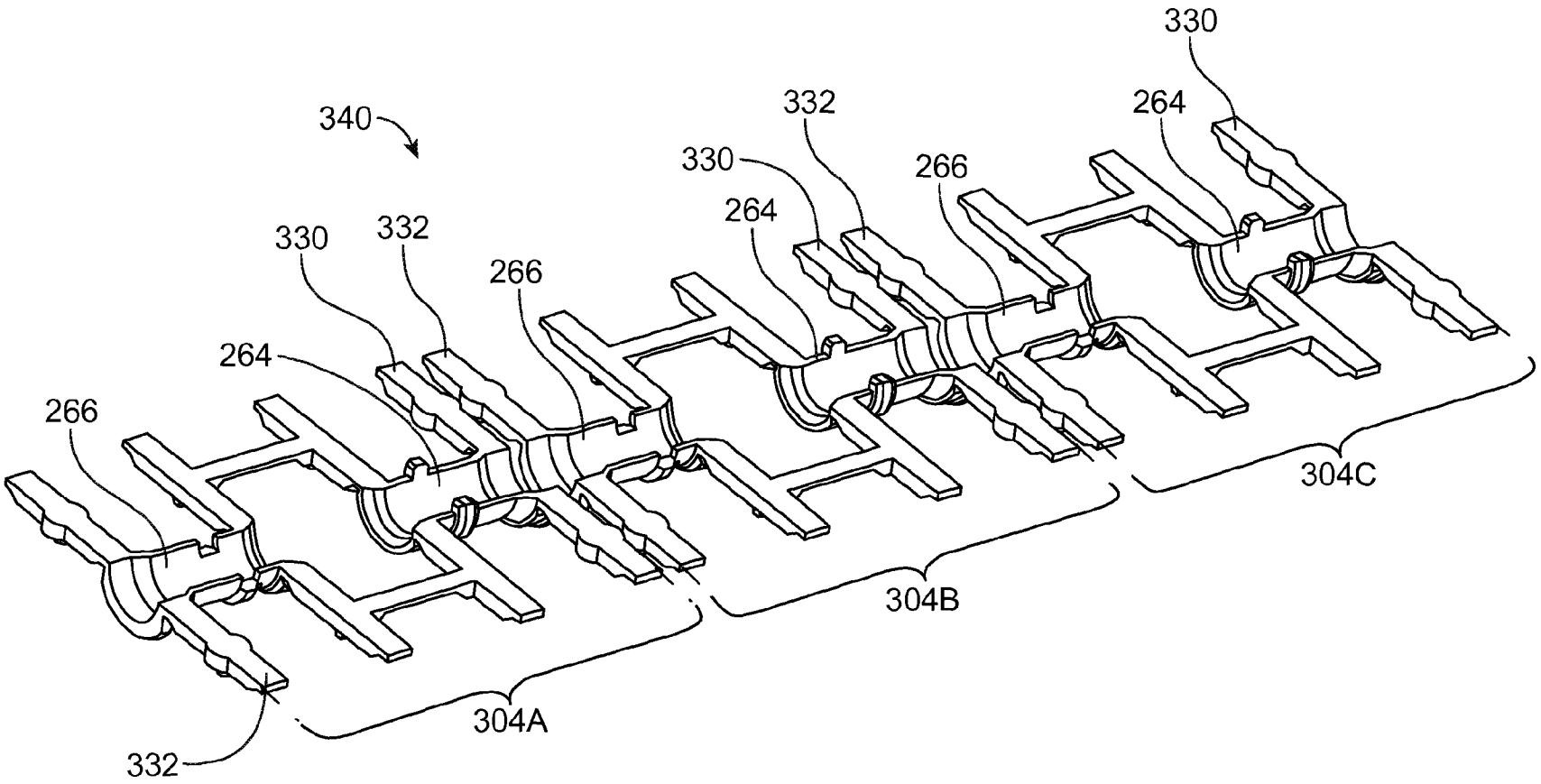
FIG. 6 is a perspective view of a lattice of multiple cavity insert bodies coupled together according to an exemplary embodiment.

FIG. 6 is a perspective view of a lattice 340 of multiple cavity insert bodies 304 coupled together according to an embodiment. For example, the illustrated lattice 340 includes three cavity insert bodies 304A, 304B, 304C, with body 304B disposed between bodies 304A and 304C. In an embodiment, the cavity insert bodies 304A-C may be formed together in the lattice 340 by a continuous molding process. The rear rails 330 of the receiving shell 264 of one cavity insert body 304 may be coupled to the front rails 332 of the closing shell 266 of an adjacent cavity insert body 304. Alternatively, instead of the cavity insert bodies 304 connecting directly to each other, the cavity insert bodies 304 may each be connected to a carrier strip (not shown) that holds the bodies 304 together. In an alternative embodiment, the cavity insert bodies 304A-C may be connected side-by-side instead of end-to-end as a result of the molding process.

Figure 7:
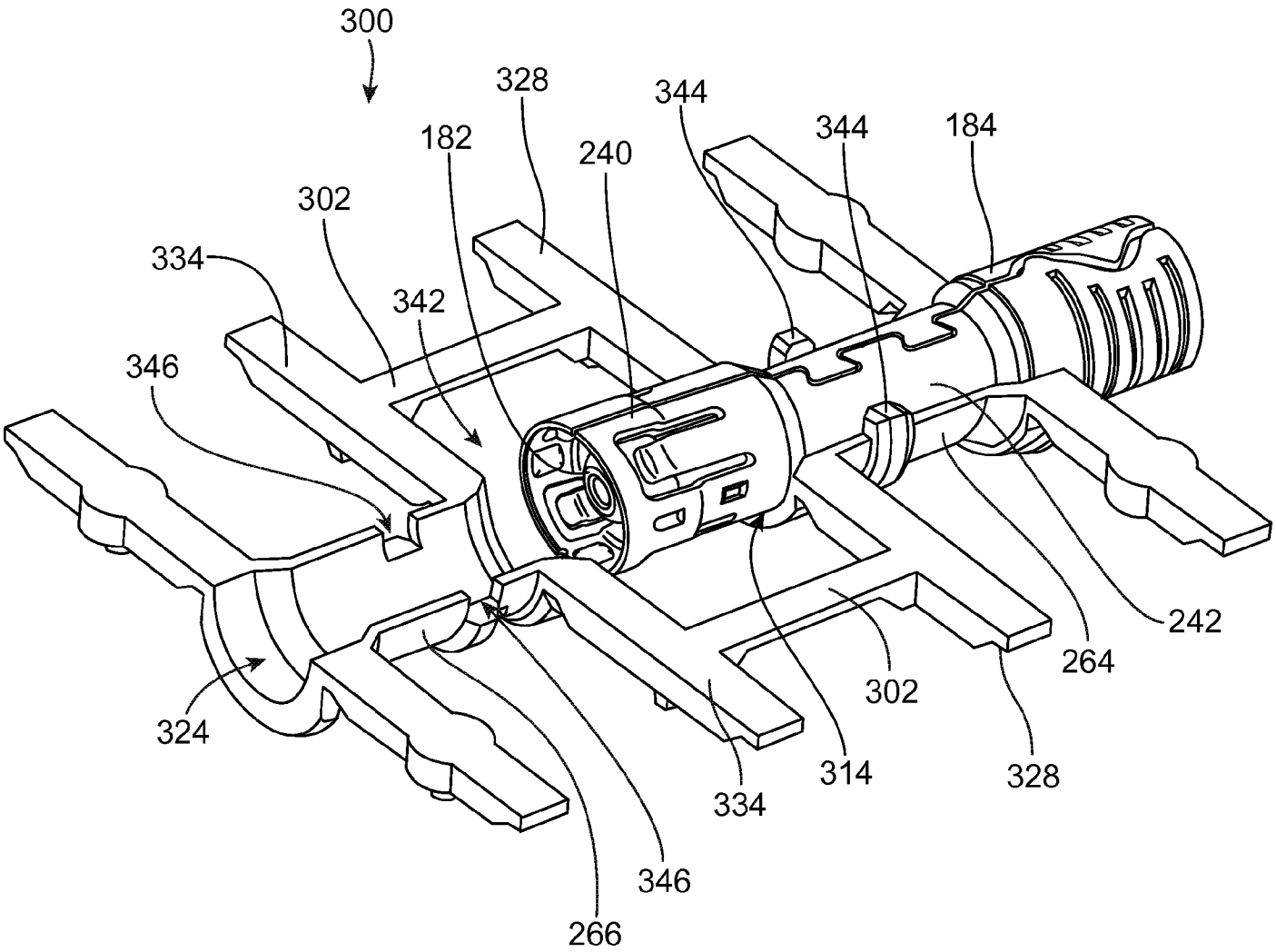
FIG. 7 is a perspective view of a dielectric and an outer contact loaded in a receiving shell of a cavity insert assembly according to an exemplary embodiment.
Figure 8:
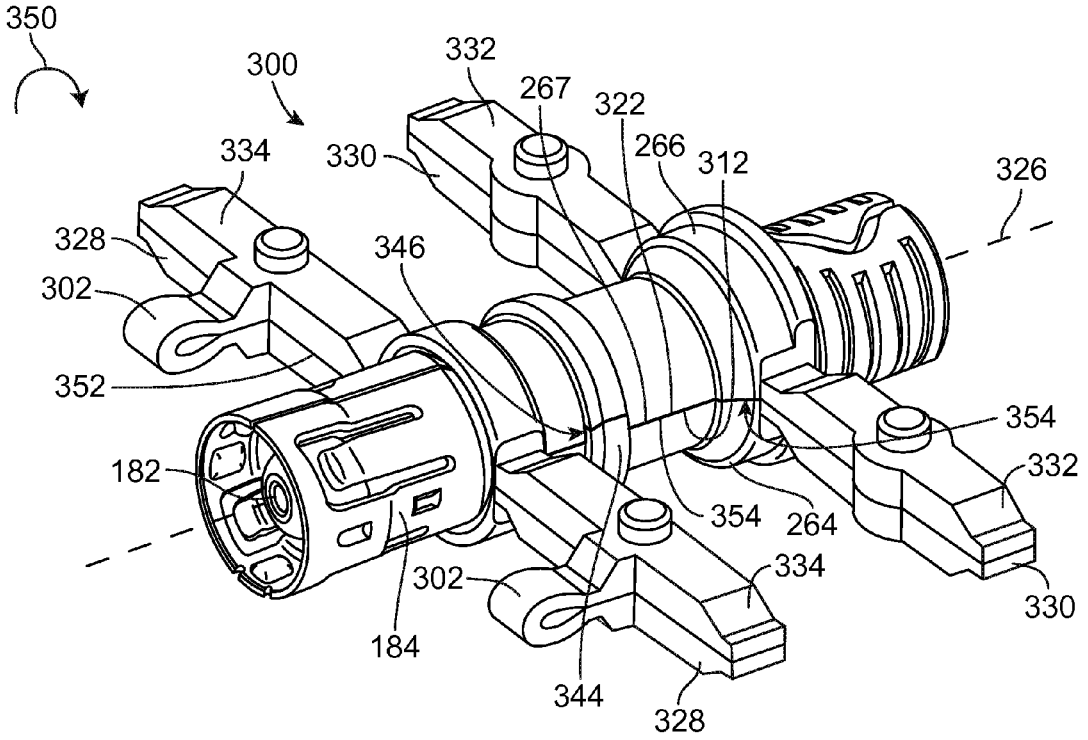
FIG. 8 is a perspective view of the dielectric and the outer contact loaded in a cavity insert assembly according to an exemplary embodiment, where the receiving shell and a closing shell of the cavity insert assembly are in a joined position.
Figure 9:
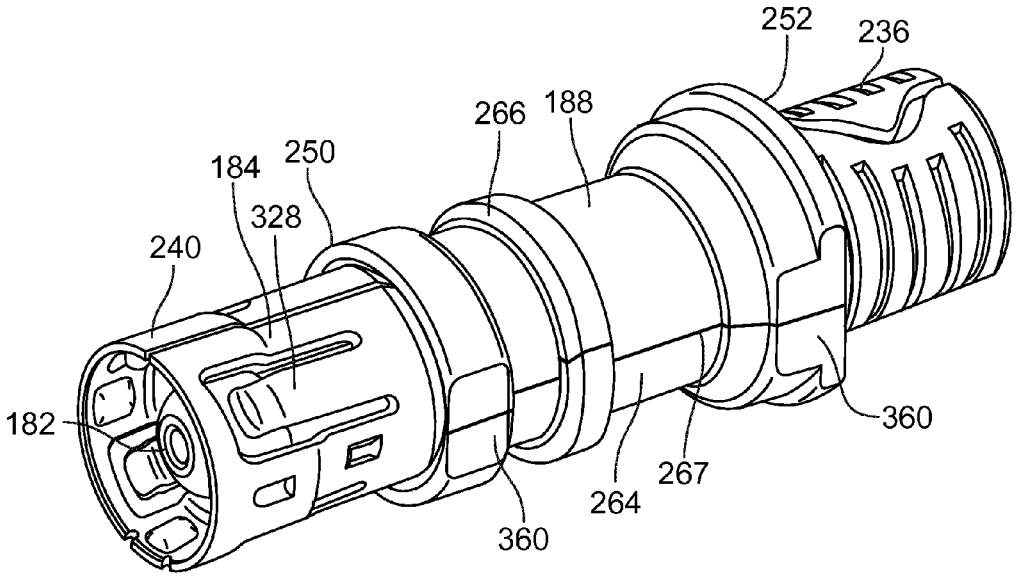
FIG. 9 is a perspective view of the dielectric and the outer contact within an assembled cavity insert formed in accordance with an exemplary embodiment.

FIGS. 7-9 describe steps for assembling the cavity insert 188 according to an exemplary embodiment. FIG. 7 is a perspective view of the dielectric 182 and the outer contact 184 loaded in the receiving shell 264 of the cavity insert assembly 300. The middle segment 242 of the outer contact 184 is received in the channel 314 of the receiving shell 264. The mating segment 240 extends forward of the receiving shell 264 into a space 342 bordered by the front rails 328 extending from the receiving shell 264, the rear rails 334 extending from the closing shell 266, and the bridges 302. The receiving shell 264 of the cavity insert assembly 300 has a keying feature 344 and the closing shell 266 has a complementary keying feature 346 that is configured to mate with the keying feature 344 when the shells 264, 266 are joined to aid in aligning the shells 264, 266. In the illustrated embodiment, the keying feature 344 is a stub and the keying feature 346 is a slot that receives the stub when the shells 264, 266 are joined. The receiving shell 264 in the illustrated embodiment includes two stubs 344, and the closing shell 266 includes two corresponding slots 346.

FIG. 8 is a perspective view of the dielectric 182 and the outer contact 184 loaded in the cavity insert assembly 300 according to an embodiment. As shown in FIG. 8, the receiving shell 264 and the closing shell 266 are in a joined position. In an exemplary embodiment, the bridges 302 form a living hinge that allows the closing shell 266 to be folded onto the receiving shell 264 at the interface 267 therebetween. For example, the closing shell 266 moves along a curved trajectory 350 generally within the cavity insert axis 326 to engage the receiving shell 264. The front 316 (shown in FIG. 5) of the closing shell 266 aligns with the rear 308 (FIG. 5) of the receiving shell 264, and the rear 318 (FIG. 5) of the closing shell 266 aligns with the front 306 (FIG. 5) of the receiving shell 264. The bridges 302 bend to provide the axis of rotation for the closing shell 266 relative to the receiving shell 264. The channel 324 (shown in FIG. 7) of the closing shell 266 may mirror the channel 314 (FIG. 7) of the receiving shell 264 as the shells 264, 266 are pressed together and combine to define the channel 254 (shown in FIG. 4) of the assembled cavity insert 188 (FIG. 4). The receiving shell 264 and the closing shell 266 together surround a full perimeter of the middle segment 242 (shown in FIG. 7) of the outer contact 184.

As the closing shell 266 is folded towards the receiving shell 264, the first end 320 (shown in FIG. 5) of the closing shell 266 is joined to or engages the first end 310 (FIG. 5) of the receiving shell 264, and the second end 322 of the closing shell 266 engages the second end 312 of the receiving shell 264. A first seam 352 is defined at the interface 267 between the first ends 310, 320 of the respective shells 264, 266. A second seam 354 is defined at the interface 267 between the second ends 312, 322 of the respective shells 264, 266. The keying features 344, 346 of the respective receiving and closing shells 264, 266 mate as the closing shell 266 engages the receiving shell 264. For example, the slots 346 receiving the stubs 344, which supports proper alignment of the shells 264, 266 and may also provide some retention to prohibit separation of the shells 264, 266. In addition, the front rails 332 extending from the closing shell 266 may align with and engage the rear rails 330 of the receiving shell 264, and the rear rails 334 may align with and engage the front rails 328.

Once the closing shell 266 is aligned with and engaging the receiving shell 264, with the outer contact 184 disposed therebetween, the shells 264, 266 may be joined together at the interface 267 by a coupling process or mechanism. In an exemplary embodiment, the shells 264, 266 may be joined by a welding process, such as by ultrasonic welding. In other embodiments, the shells 264, 266 may be joined by an adhesive, a latching mechanism, a friction fit, or the like. After the coupling process or mechanism, the shells 264, 266 are secured together around the middle segment 242 (shown in FIG. 7) of the outer contact 184. Using ultrasonic welding, for example, the two shells 264, 266 may be permanently secured together.

FIG. 9 is a perspective view of the dielectric 182 and the outer contact 184 within an assembled cavity insert 188. In an embodiment, the assembled cavity insert 188 is completed upon removing the bridges 302 (shown in FIG. 8) and rails 328-334 (FIG. 8) from the cavity insert assembly 300 (FIG. 8) after joining the receiving and closing shells 264, 266. The bridges 302 and rails 328-334 may be removed by cutting or trimming at the locations where the rails 328-334 extend from the shells 264, 266. Alternatively, the rails 328-334 and/or bridges 302 may be bent and twisted, chemically milled, or the like, to remove the rails 328-334 and bridges 302 from the shells 264, 266. Once the rails 328-334 and bridges 302 are removed, the assembled cavity insert 188 may have one or more cut regions 360. The cut regions 360 indicate an area where trimming has occurred to remove rails 328-334 from the shells 264, 266. The cut regions 360 may be located at the interface 267 between the shells 264, 266. The cut regions 360 may be relatively planar instead of being curved along the barrel-shaped perimeter of the cavity insert 188.

When the outer contact 184 is within the cavity insert 188, the mating segment 240 of the outer contact 184 extends forward of the cavity insert 188. In an alternative embodiment, the cavity insert 188 may include a sleeve (not shown) at the front end 250 that circumferentially surrounds the mating segment 240 of the outer contact 184 to protect the contact beams 228, such as during loading of the second connector assembly 104 (shown in FIG. 1) into the outer housing 192 (FIG. 2) and/or during mating of the second connector assembly 104 with the first connector assembly 102 (FIG. 1). In an embodiment, the terminating segment 236 of the outer contact 184 extends rearward of the rear end 252 of the cavity insert 188.

Figure 10:
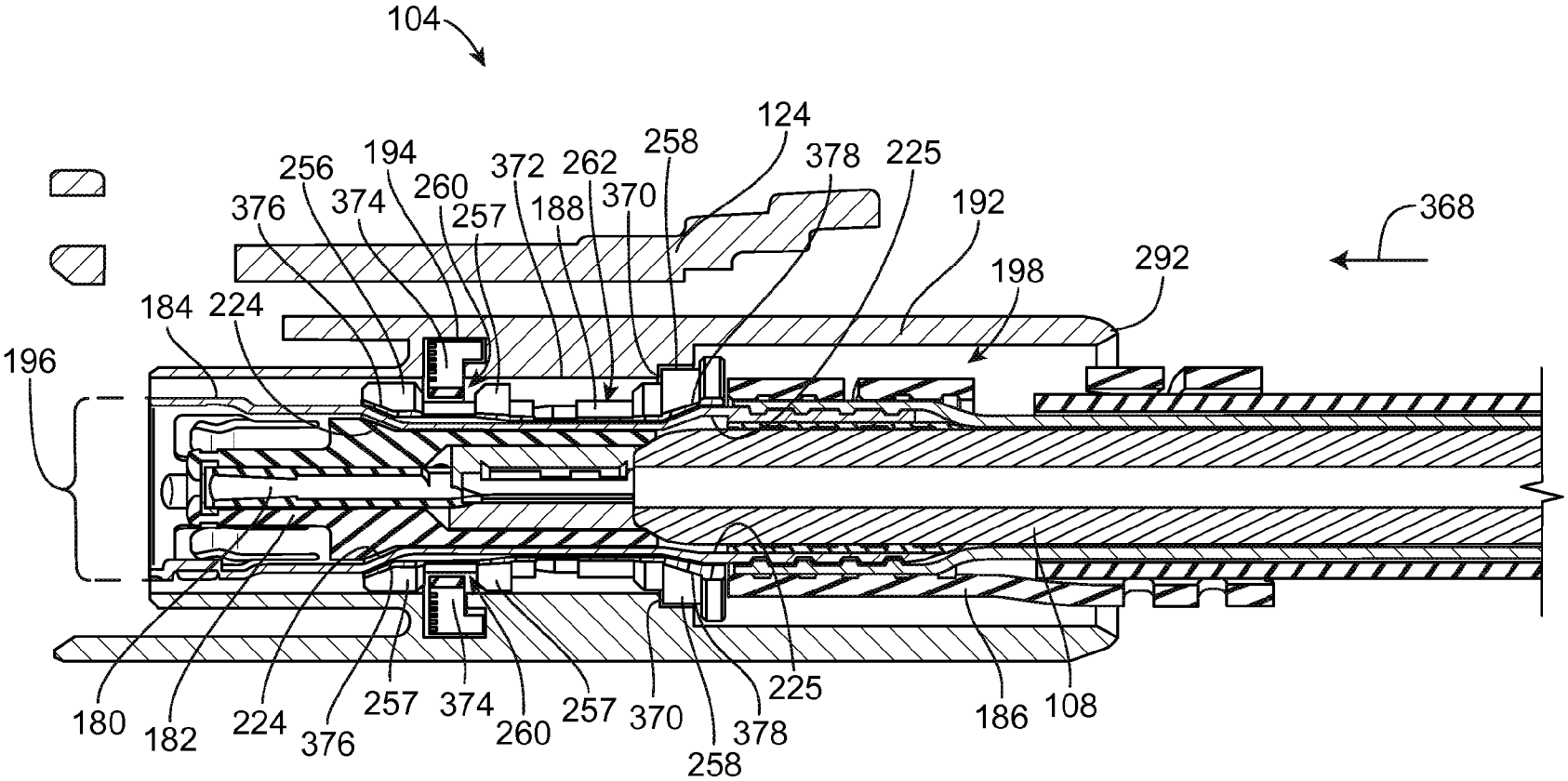
FIG. 10 is a cross-section of the second connector assembly according to an exemplary embodiment.

FIG. 10 is a cross-section of the second connector assembly 104 according to an exemplary embodiment. The second connector subassembly 196 is loaded into the cavity 198 of the outer housing 192 from the rear 292 of the outer housing 192 in a loading direction 368. The rear flange 258 of the cavity insert 188 contacts a shoulder 370 along an inner surface 372 of the outer housing 192 to prohibit further movement of the second connector subassembly 196 in the loading direction 368. An arm 374 of the retainer 194 is receiving within the first groove 260 of the cavity insert 188, between the front and middle flanges 256, 257. The arm 374 of the retainer 194 contacts the front flange 256 and/or the middle flange 257 to prohibit axial movement of the second connector subassembly 196 relative to the retainer 194. The retainer 194 is coupled to the outer housing 192, so the retainer 194 locks the cavity insert 188 into the cavity 198 of the outer housing 192 to hold the axial position of the subassembly 196 within the cavity 198. The latching feature 124 of the outer housing 192 and/or the latching feature 122 (FIG. 1) of the first connector assembly 102 (FIG. 1) may be received within the second groove 262 of the cavity insert 188 when the first connector assembly 102 is mated to the second connector assembly 104.

In an embodiment, the first shoulder 224 of the outer contact 184 engages a flared front end 376 of the cavity insert 188 and the second shoulder 225 engages a flared rear end 378 of the cavity insert 188 to hold the axial position of the outer contact 184, including the attached cable 108, outer ferrule 186, dielectric 182, and center contact 180 therein, relative to the cavity insert 188 and outer housing 192. As such, the cavity insert 188 may be axially positioned and held between the mating segment 240 and the terminating segment 236 of the outer contact 184.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A connector assembly comprising:

a center contact configured to be terminated to a center conductor of a cable;

a dielectric holding the center contact;

an outer contact surrounding the dielectric and the center contact, the outer contact having a mating segment extending from a mating end, a terminating segment extending from a cable end, and a middle segment between the mating and terminating segments, the terminating segment configured to be terminated to a braid of the cable, the middle segment having a diameter that is less than respective diameters of the mating and terminating segments, the outer contact including a first shoulder separating the middle segment from the mating segment and a second shoulder separating the middle segment from the terminating segment; and a cavity insert surrounding the middle segment of the outer contact, the cavity insert including a receiving shell and a closing shell that are joined together at an interface to define the cavity insert, the cavity insert including a front flared end, a rear flared end, and an intermediate segment between the front and rear flared end segments, the cavity insert defining a channel therethrough, the channel along the intermediate segment having a diameter that is less than respective diameters of the channel along the front and rear flared end, wherein the first shoulder of the outer contact aligns with and engages the front flared end and the second shoulder aligns with and engages the rear flared end to secure an axial position of the outer contact relative to the cavity insert.

2. The connector assembly of claim 1, wherein the receiving shell and the closing shell are ultrasonically welded together at the interface.

3. The connector assembly of claim 1, wherein the cavity insert is barrel-shaped, the receiving shell forming a portion of a perimeter of the cavity insert and the closing shell forming a remaining portion of the perimeter of the cavity insert.

4. The connector assembly of claim 1, wherein the diameter of the channel of the cavity insert along the intermediate segment is less than the respective diameters of the mating and terminating segments of the outer contact such that the outer contact cannot be loaded axially into the channel of the cavity insert when the receiving shell and the closing shell are joined together.

5. The connector assembly of claim 1, wherein the center contact, the dielectric, the outer contact, and the cavity insert define a subassembly, the connector assembly further comprising an outer housing having a cavity receiving the subassembly, the cavity insert including at least one flange that is locked into the outer housing to hold the axial position of the subassembly within the cavity.

6. The connector assembly of claim 1, wherein the receiving shell of the cavity insert includes a first end and an opposite second end and the closing shell includes a first end and an opposite second end, the first end of the receiving shell joined to the first end of the closing shell at a first seam and the second end of the receiving shell joined to the second end of the closing shell at a second seam.

7. The connector assembly of claim 1, wherein the outer contact includes a securing feature and the cavity insert includes a complementary securing feature engaging the securing feature of the outer contact to hold the axial position of the outer contact with respect to the cavity insert.

8. The connector assembly of claim 1, wherein the mating end of the outer contact includes a ring, the mating segment having a plurality of contact beams disposed between the ring and the middle segment and a plurality of protrusions extending radially inward from the mating segment, the contact beams and protrusions being configured to engage an outer contact of a mating connector assembly.

9. The connector assembly of claim 1, wherein the receiving shell of the cavity insert has a keying feature and the closing shell has a complementary keying feature, the respective keying features mating to align the closing and receiving shells around the outer contact.

10. The connector assembly of claim 1, wherein the cavity insert includes a cut region located at the interface between the receiving shell and the closing shell, the cut region indicative of a rail that is trimmed from the cavity insert.

11. The connector assembly of claim 1, wherein the outer contact defines a cavity extending therethrough between the mating end and the cable end, the dielectric and the center contact being held in the cavity along at least the mating segment and the middle segment of the outer contact.

12. A connector assembly comprising:

a center contact configured to be terminated to a center conductor of a cable;

a dielectric holding the center contact;

an outer contact surrounding the dielectric and the center contact, the outer contact having a mating segment extending from a mating end, a terminating segment extending from a cable end, and a middle segment between the mating and terminating segments, the terminating segment configured to be terminated to a braid of the cable, the middle segment having a diameter that is less than respective diameters of the mating and terminating segments, the outer contact including a first shoulder separating the middle segment from the mating segment and a second shoulder separating the middle segment from the terminating segment; and a cavity insert assembly that includes a receiving shell, a closing shell, and a bridge that connects the receiving shell to the closing shell, the receiving shell, closing shell, and the bridge being co-molded as part of a unitary cavity insert body, the receiving shell defining a channel that is configured to receive the middle segment of the outer contact therein, the receiving shell including a front flared end, a rear flared end, and an intermediate segment between the front and rear flared end segments, the channel along the intermediate segment having a diameter that is less than respective diameters of the channel along the front and rear flared end, wherein the first shoulder of the outer contact aligns with and engages the front flared end and the second shoulder aligns with and engages the rear flared end to secure an axial position of the outer contact relative to the receiving shell.

13. The connector assembly of claim 12, wherein the bridge forms a living hinge that allows the closing shell to be folded onto the receiving shell, the closing shell defining a channel that mirrors the channel of the receiving shell, the receiving shell and the closing shell together surrounding a full perimeter of the middle segment of the outer contact when the closing shell is folded onto the receiving shell.

14. The connector assembly of claim 13, wherein a first end of the closing shell is configured to be joined to a first end of the receiving shell and a second end of the closing shell is configured to be joined to a second end of the receiving shell to form an assembled cavity insert.

15. The connector assembly of claim 14, wherein the receiving shell and the closing shell are ultrasonically welded together to form an assembled cavity insert.

16. The connector assembly of claim 12, wherein the receiving shell and the closing shell of the cavity insert assembly are oriented along a cavity insert axis, the cavity insert assembly further including a rail that extends from the receiving shell at an angle transverse to the cavity insert axis and a rail that extends from the closing shell at an angle transverse to the cavity insert axis, the bridge connecting the rail extending from the receiving shell to the rail extending from the closing shell.

17. The connector assembly of claim 16, wherein the bridge forms a living hinge that allows the closing shell to be folded onto the receiving shell and to be joined to the receiving shell at an interface therebetween, the rail and the bridge being subsequently removable after the closing shell and the receiving shell are joined to form an assembled cavity insert.

18. The connector assembly of claim 12, wherein the cavity insert assembly is assembled to form a cavity insert, the cavity insert, the outer contact, the dielectric, and the center contact defining a subassembly, the connector assembly further comprising an outer housing having a cavity receiving the subassembly, the cavity insert including at least one flange that is locked into the outer housing to hold the axial position of the subassembly within the cavity.

19. The connector assembly of claim 12, wherein the closing shell defines a channel that mirrors the channel of the receiving shell, the channels of the closing shell and the receiving shell extending axially between respective front and rear ends of each of the closing and receiving shells, the bridge extending from the front end of the receiving shell to the rear end of the closing shell.

20. The connector assembly of claim 12, wherein the channel of the receiving shell is oriented along a cavity insert axis between a front end and a rear end of the receiving shell, the bridge extending a length from the receiving shell to the closing shell, the length of the bridge oriented parallel to the cavity insert axis.

* * * * *